US012557955B2

(12) United States Patent
Strang et al.

(10) Patent No.: US 12,557,955 B2
(45) Date of Patent: Feb. 24, 2026

(54) ATTACHMENT FOR A CLEANING DEVICE WITH MOISTURE DETECTION AND METHOD FOR MOISTURE DETECTION

(71) Applicant: Vorwerk & Co. Interholding GmbH, Wuppertal (DE)

(72) Inventors: Benjamin Strang, Solingen (DE); Birgit Petersen, Grevelsberg (DE); Robin Janssen, Duisburg (DE); Marc Papenheim, Wuppertal (DE); Roland Kraus, Mettmann (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 173 days.

(21) Appl. No.: 17/975,931

(22) Filed: Oct. 28, 2022

(65) Prior Publication Data

US 2023/0135649 A1 May 4, 2023

(30) Foreign Application Priority Data

Oct. 29, 2021 (EP) ..... 21205457

(51) Int. Cl.

| | |
|---|---|
| ***A47L 13/22*** | (2006.01) |
| ***A47L 9/28*** | (2006.01) |
| ***A47L 11/20*** | (2006.01) |
| ***A47L 11/40*** | (2006.01) |

(52) U.S. Cl.

CPC ..... *A47L 9/2826* (2013.01); *A47L 11/201* (2013.01); *A47L 11/4011* (2013.01); *A47L 11/4088* (2013.01)

(58) Field of Classification Search

None

See application file for complete search history.

(56) References Cited

U.S. PATENT DOCUMENTS

2011/0166763 A1* 7/2011 Choi ..... G05D 1/027 701/82
2014/0259510 A1 9/2014 Conrad
2017/0367553 A1* 12/2017 Liang ..... A47L 11/4047

(Continued)

FOREIGN PATENT DOCUMENTS

CN 109199259 * 1/2019
CN 109222769 A 1/2019

(Continued)

OTHER PUBLICATIONS

Merriam-Webster Dictionary definition of "moisture".*

(Continued)

*Primary Examiner* — Kaj K Olsen
*Assistant Examiner* — Ryan L Coleman
(74) *Attorney, Agent, or Firm* — The Webb Law Firm

(57) ABSTRACT

The invention relates to a cleaning device, in particular a suction wiper, having a housing with at least one cleaning medium for receiving a cleaning agent, having a cleaning medium carrier for receiving the cleaning medium, having a drive for driving the cleaning medium carrier and having a controller. At least one vibration sensor for detecting a strength of a vibration is arranged in the housing and the controller is designed to determine the moisture of the cleaning medium, the controller evaluating a change in the strength of the vibration. The invention also relates to a method for operating a cleaning device.

14 Claims, 3 Drawing Sheets

(56) References Cited

U.S. PATENT DOCUMENTS

Figure 1:
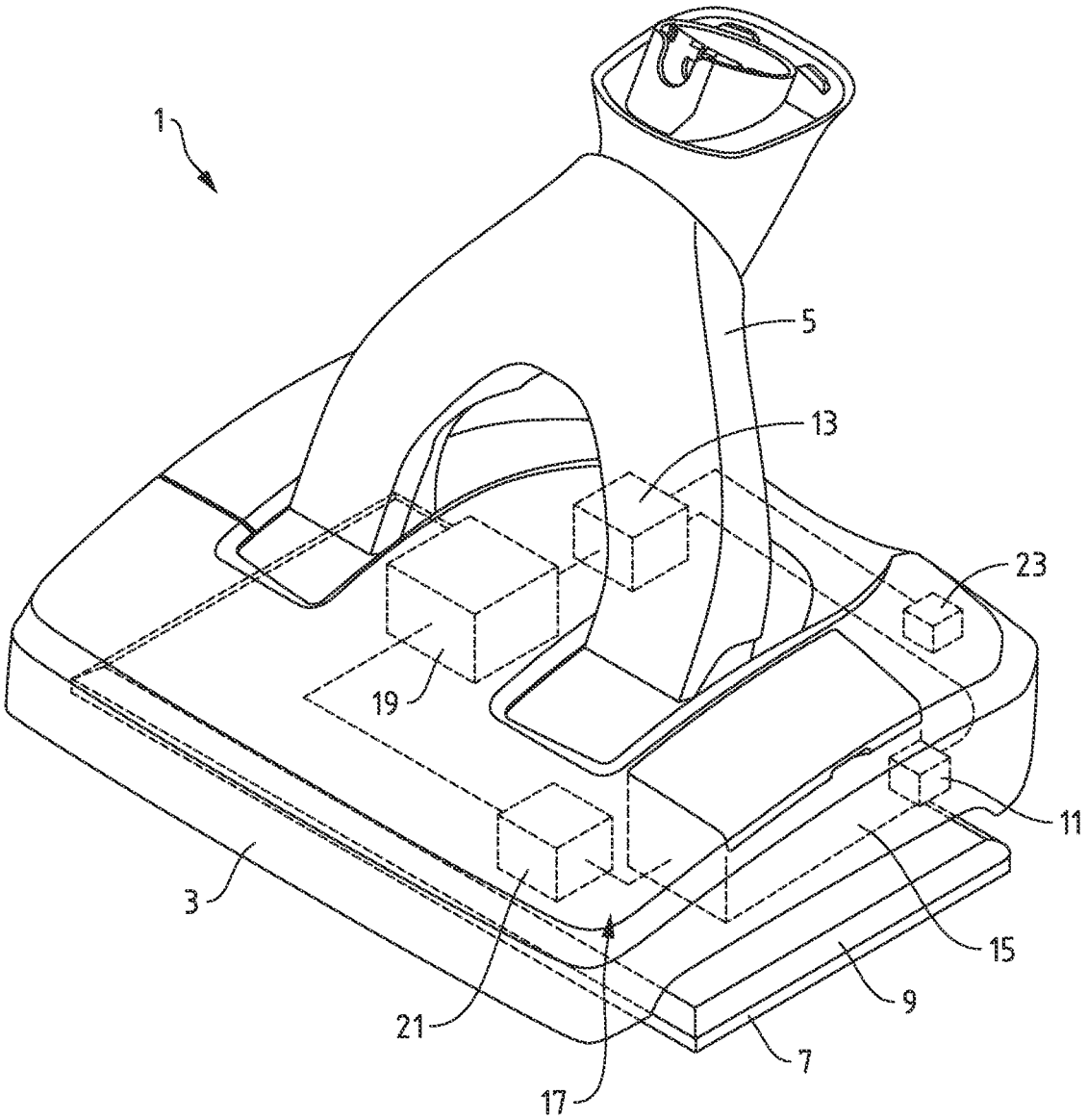

| | | | | |
|---|---|---|---|---|
| 2019/0204851 | A1* | 7/2019 | Afrouzi | A47L 9/0405 |
| 2020/0121153 | A1* | 4/2020 | Letsky | A47L 9/2873 |
| 2020/0288936 | A1* | 9/2020 | Knutson | A47L 11/4036 |

FOREIGN PATENT DOCUMENTS

| | | | |
|---|---|---|---|
| CN | 109910032 | * | 6/2019 |
| CN | 212165727 | * | 12/2020 |
| CN | 112987716 | * | 6/2021 |
| DE | 102017110848 | A1 | 11/2018 |
| JP | 201738926 | A | 2/2017 |

OTHER PUBLICATIONS

Translation of CN109222769 by Tan, published Jan. 18, 2019.*
Translation of CN112987716 by Zhang, published Jun. 18, 2021.*
Translation of CN212165727 by Wu, published Dec. 18, 2020.*
Translation of CN109910032 by Jiang, published Jun. 21, 2019.*
Translation of CN109199259 by Tan, published Jan. 15, 2019.*

* cited by examiner

ATTACHMENT FOR A CLEANING DEVICE WITH MOISTURE DETECTION AND METHOD FOR MOISTURE DETECTION

CROSS-REFERENCE TO RELATED APPLICATION

This application claims priority to European Patent Application No. 21205457.1 filed Oct. 29, 2021, the disclosure of which is hereby incorporated by reference in its entirety.

BACKGROUND OF THE INVENTION

Field of the Invention

The invention relates to a cleaning device, in particular a suction wiper, having a housing with at least one cleaning medium for receiving a cleaning agent, having a cleaning medium carrier for receiving the cleaning medium, having a drive for driving the cleaning medium carrier and having a controller. The invention also relates to a method for operating a cleaning device.

Description of Related Art

Cleaning devices for various fields of application are known from the prior art, which can be designed, for example, as a cleaning device with an attachment that can be operated by a user or as a cleaning robot, wherein the cleaning devices or attachments are designed for different cleaning tasks, for example for mopping, for vacuuming or for a combination of these tasks. For example, attachments are known which are designed as wiping heads for wiping cleaners, in which a cleaning medium impregnated with cleaning agent is used to clean the floor. Also known are attachments, which are designed as suction nozzles for hoovers, in which a suction stream is used to clean the floor, as well as attachments, which are designed as combination nozzles for use in suction wipers.

For the purposes of the application, the term cleaning device is understood to designate, inter alia, a cleaning device with an attachment, an attachment for use with a cleaning device, or a cleaning robot.

In the case of mop cleaners or suction mops, the cleaning performance or cleaning result depends on the moisture of the cleaning medium, the optimum value of which is determined, among other things, by the surface nature of a floor to be cleaned. For example, a floor to be cleaned with a rough surface or a heavily soiled surface requires a different moisture than a floor to be cleaned that has a smooth surface or that is only lightly soiled. In this context, moisture is understood to be the content of cleaning agent in the liquid aggregate state, in particular a mixture of water and surfactants, in the cleaning medium.

To support or improve the cleaning result, the cleaning medium carrier and thus the cleaning medium can be set into an oscillating movement by the drive, whereby the term oscillating movement is understood to mean an oscillating movement essentially parallel or quasi-parallel to an underside of the housing. The drive comprises all means necessary for generating the oscillating movement of the cleaning medium carrier. For example, the drive can have an electric motor, an eccentric gear, a cam disc or similarly suitable means.

In addition to influencing the cleaning result, the moisture of the cleaning medium also affects the user comfort for a user using the cleaning device, as the moisture of the cleaning medium significantly influences the vibrations of the cleaning device, which are perceived by a user, whereby high vibrations, i.e. a high strength of the vibrations, are usually perceived as unpleasant. These vibrations can also be referred to as perceived vibration.

In order to determine the moisture of the cleaning medium, various sensors, for example infrared (IR) or capacitive sensors, are used in cleaning devices of the prior art, which are arranged on the cleaning medium carrier and/or on an underside of the housing of the cleaning device facing the cleaning medium carrier. The controller housed in the housing of the cleaning device can inform the user about the determined moisture of the cleaning medium, whereupon the user can carry out a manual correction of the moisture, in particular a re-moistening of the cleaning medium.

However, a disadvantage of the cleaning devices known from the state of the art is that the sensors for determining the moisture are arranged in a dirt area. In this context, the dirt area is understood to be the area of the cleaning device that comes into contact with a floor to be cleaned, with the cleaning medium, with the cleaning medium carrier and/or the cleaning agent during use of the cleaning device.

Furthermore, in known cleaning devices, there is no adaptation of the moisture of the cleaning medium to the surface nature of the floor to be cleaned or the surface nature has to be determined separately by a user, for example by using a so-called floor map, so that under certain circumstances, optimal cleaning of the floor to be cleaned is not possible or can only be achieved with great effort on the part of the user.

The vibrations caused by the oscillating movement can be transmitted to a user when the cleaning device is in use, which is generally perceived as unpleasant if the vibrations are too high and can lead to chronic overload irritation if the cleaning device is used frequently. The vibrations can also cause increased wear and tear and thus premature component failure within the cleaning device.

SUMMARY OF THE INVENTION

On this basis, the aim of the present invention is to provide a cleaning device of the type mentioned above and a method for operating a cleaning device, which overcome at least one of the problems described above.

According to the invention, this task is solved by a cleaning device as described herein. Preferred and advantageous embodiments of a cleaning device according to the invention are indicated in the subclaims. The task is also solved by a method for operating a cleaning device.

The cleaning device according to the invention is characterised in that at least one vibration sensor for detecting a strength of a vibration is arranged in the housing, and in that the controller is adapted to determine the moisture of the cleaning medium, wherein the controller evaluates a change in the strength of the vibration.

According to the invention, it has been recognised that the moisture of the cleaning medium can be determined via the strength of the vibrations induced by the oscillating movement of the cleaning medium—cleaning medium carrier system, since the moisture of the cleaning medium changes the total oscillating mass of the system. For example, a higher moisture leads to an increase in the total vibrating mass, whereby a strength of the vibrations can be determined at the housing of the cleaning device, which is different from the strength of the vibrations resulting from the total vibrating mass in the case of a dry cleaning medium or a cleaning medium with a lower moisture. Thus, the change in the strength of the vibrations detected by the vibration sensor is a measure of the moisture content of the cleaning medium, and at an optimum moisture content, the strength of the vibrations may be minimal, thereby improving the comfort of use of the cleaning device for a user and the life of the cleaning device. Also, optimal moisture improves the cleaning result for the floor currently being cleaned.

Preferably, the vibrations or the strength of the vibration are detected in the direction (detection direction) perpendicular to the plane in which the cleaning medium extends (horizontal direction). This plane is parallel to the underside of the housing and, when the cleaning device is in use, parallel or substantially parallel to the floor to be cleaned. The vibrations or the strength of the vibration in this direction, which is referred to below as the vertical direction, is largely independent of the surface nature of the floor to be cleaned.

In this context, the strength of the vibration is preferably understood as the acceleration caused by the vibration. However, it is also possible to use the amplitude/deflection or the frequency of the vibrations as a basis for the determination.

The strength of the vibrations is detected by the vibration sensor and the data is transmitted to the controller, for example in the form of an electrical and/or digital signal. The controller evaluates the data transmitted by the vibration sensor and determines the moisture of the cleaning medium from this. The determined moisture can be displayed to a user using the cleaning device, for example via a display integrated in the cleaning device, so that the user can change the moisture of the cleaning medium if the moisture of the cleaning medium is unsuitable for the floor to be cleaned or the strength of the vibrations deviates from the optimum value for the current conditions of use. For this purpose, the user can, for example, add cleaning agent to the cleaning medium. Accordingly, the user can work on the floor to be cleaned with an optimised moisture, whereby the cleaning result is improved and/or the vibrations or the strength of the vibrations are minimised. The optimal values can be provided to the user, for example, in the form of a table in the user manual of the cleaning device or the like.

Within the scope of the invention, the vibration sensor can be designed as an acceleration sensor or gyroscope, whereby the use or arrangement of several vibration sensors for spatially resolved detection of the vibrations or for detection in several spatial directions is also possible, in order, for example, to detect the vibrations in the horizontal and vertical directions separately from one another or to be able to form a vector sum to determine the strength of the vibrations.

Preferably, the controller has a communication interface by means of which the controller can communicate with one or more external devices. It is conceivable that the controller communicates with a smart device, in particular a smart home system or a smartphone, in order to provide the user with various data of the cleaning device or to receive input data from the user.

In a further embodiment of the cleaning device, the controller is designed to determine the surface nature of a floor to be cleaned, whereby the controller evaluates performance data of the drive to determine the surface nature. For this purpose, the controller is connected to the drive for transfer of signals. Via this connection, information about the performance data of the drive, in particular of the electric motor, is transmitted to the controller, which then determines the surface nature of the floor to be cleaned, in particular the coefficient of friction, from the transmitted data. Performance data is in particular the electrical energy absorbed by the electric motor of the drive or generated by means of induction, which can also be referred to as power consumption or power output. For the determination, in a first operating mode, in which the cleaning device is switched on but the cleaning medium does not perform any oscillations, the cleaning device can be pushed by a user over the floor to be cleaned, whereby the friction between the cleaning medium and the surface of the floor to be cleaned deflects the cleaning medium or the cleaning medium carrier from the original position and the electric motor is operated as a generator for a short time. The information about the measured induced electrical energy is a measure of the surface nature, in particular the coefficient of friction, of the floor to be cleaned, as the power consumption of the electric motor is negative in this case. For example, in the case of a rough floor, the cleaning medium carrier is quickly moved to another position when the cleaning device is moved, resulting in a high induction. On a smooth floor, on the other hand, the cleaning medium carrier only undergoes a slight change in position, which means that only a low induction can be detected.

Alternatively or complementarily, in another operating mode in which the cleaning medium performs vibrations, the power consumption of the electric motor, which is greater for a rough surface (high coefficient of friction) than for a smooth surface (low coefficient of friction), can be used to determine the surface nature of the floor to be cleaned, the power consumption of the electric motor being positive in both cases.

In a preferred embodiment of the cleaning device, the vibration sensor has at least one acceleration sensor for detecting a movement of the housing. The arrangement of an acceleration sensor within the housing of the cleaning device improves the determination of the moisture of the cleaning medium. For this purpose, the acceleration sensor can be used to detect accelerations of the cleaning device caused by the movement of the cleaning device, for example by a user pushing the device back and forth or by a collision with obstacles, or the vibrations caused thereby, so that the controller, which is prepared for evaluating the data and is connected to the acceleration sensor for transfer of signals, can discriminate the vibrations generated by the vibrating mass or the strength of the vibrations from these vibrations caused by the movement of the cleaning device.

Advantageously, the controller has a memory unit and the controller is adapted to compare a detected strength of the vibration with at least one defined or definable strength of a vibration. A defined or definable strength of a vibration can be a strength of a vibration stored in the memory unit, which characterises an optimal moisture for a predefined application, or a plurality of strengths of vibrations, which were detected during at least one previous use of the cleaning device and stored in the memory unit of the controller. After a comparison, the controller can, for example, inform the user if an excessive deviation between the strengths is detected in order to ensure an improved cleaning result or increased user comfort.

Preferably, the controller can also be adapted to compare a specific surface nature with at least one defined or definable surface nature. A defined or definable surface nature can be a surface nature stored in the memory unit or a plurality of surface natures that have been determined during at least one previous use of the cleaning device and stored in the memory unit of the controller. After a comparison, the controller can, for example, inform the user if an excessive deviation between the surface natures is detected in order to ensure an improved cleaning result.

According to a further embodiment of the cleaning device, a cleaning agent dosing unit is arranged in the housing, the cleaning agent dosing unit having a tank, an electrically actuable pump and a data and signal interface, and the controller is adapted to evaluate the data of the cleaning agent dosing unit.

The electrically operated pump enables an automatic supply of cleaning agent to the cleaning medium. The supply of cleaning agent can be time-controlled, by a user action or depending on the moisture determined by the controller. For the supply, the electrically operable pump conveys cleaning agent from the tank, which is fluidically connected to the pump, to the cleaning medium. For example, a predefined amount of cleaning agent can be supplied after a defined period of time (e.g. every 60 seconds), after the user has actuated a switch connected to the cleaning agent dosing unit by means a communication connection for transferring signals, or after the controller has determined that the moisture level is too low. Via the data and signal interface, the cleaning agent dosing unit can receive an activation signal from the control, in particular after determination of insufficient moisture, whereupon cleaning agent is supplied, as well as the amount of cleaning agent supplied by the electrically operable pump can be reported to the control. The automatic supply of cleaning agent can further improve the cleaning of the floor to be cleaned. Furthermore, the amount of cleaning agent delivered by the cleaning agent dosing unit to the controller enables a further improvement in the accuracy of the determination of the moisture of the cleaning medium, in that the amount of cleaning agent delivered by the pump, which also represents a measure of the moisture of the cleaning medium, is used as a starting value which is used as a basis for the determination of the moisture of the cleaning medium by the controller.

According to an advantageous embodiment of the cleaning device, the controller is adapted to notify a user when at least one threshold value of a strength of a vibration, preferably an upper and lower threshold value, is undershot and/or exceeded. For example, the controller can inform the user when an upper threshold value is exceeded at which damage to the cleaning device, in particular to the drive or the cleaning medium carrier, is to be feared. In this case, the controller takes into account in particular the duration of an undershooting or overshooting of the threshold value in order to refrain from notifying a user if the threshold value is only undershot or overshot for a short period of time. The necessary threshold values can be stored in the memory unit of the controller.

By means of the threshold values of a vibration strength, the condition of the cleaning medium, in particular the wear of the cleaning medium, can be detected. For example, a threshold value can be used to detect a pending replacement of the cleaning medium, which is necessary if the cleaning medium is too dirty or too worn. For this purpose, the necessary threshold values, some of which are specific to the cleaning medium, are stored in the memory unit of the controller.

Preferably, the controller may be adapted to detect an unacceptable moisture of the cleaning medium and to notify the user in the presence of an unacceptable moisture of the cleaning medium. In this context, an unacceptable moisture is a moisture that is detected after the end of a use. This is the case, for example, when the cleaning device is put down after use with the cleaning medium still moist. In order to determine the impermissible moisture, the controller can take the last measured data of the vibration sensor and compare it with the vibration data of the dry cleaning medium at the beginning of use. It is also possible to record the last amount of cleaning agent delivered by the pump to the cleaning medium. For the power supply of the controller and any notification means (e.g. display, communication interface), a rechargeable battery located in the housing or a power source connected to the cleaning device can be used.

The above technical problem is also solved by a method for operating a cleaning device, preferably a cleaning device according to the invention, in which a moisture of a cleaning medium is determined by evaluating the change in a strength of a vibration detected by a vibration sensor. At least one vibration sensor is provided for the method, although a plurality of vibration sensors can also be used.

The vibration sensor detects the vibrations caused by the oscillating cleaning medium, which can be a measure of the moisture of the cleaning medium, and forwards these to a controller of the cleaning device, which evaluates the transmitted data. Accordingly, the method enables the moisture of the cleaning medium to be determined. The moisture determined in this way can be transmitted to a user using the cleaning device, so that the user can adjust the moisture of the cleaning medium in order to improve the cleaning result or the user comfort.

In a further embodiment of the method, a surface nature of a floor to be cleaned is determined by means of a power consumption of a drive connected to the cleaning medium carrier. To determine the surface nature of the floor to be cleaned, in particular the coefficient of friction, the data of a drive of the cleaning device can be used, which are evaluated in the controller of the cleaning device. The data is the power consumption of an electric motor integrated in the drive. The determined surface nature can be used to improve the cleaning result by cleaning the floor to be cleaned with an optimal moisture of the cleaning medium with regard to the surface nature of the floor to be cleaned.

In a further embodiment of the method, the moisture of the cleaning medium is varied as a function of the strength of the vibrations detected by the vibration sensor by supplying cleaning agent to the cleaning medium through a cleaning agent dosing unit. By varying the moisture of the cleaning medium as a function of the detected strength of the vibrations, on the one hand an optimum moisture for the floor to be cleaned can be set, so that the cleaning result is improved. On the other hand, by varying the moisture, an absolute or local vibration minimum can be set, whereby the user comfort for a user using a cleaning device operated by means of the method can be improved.

Preferably, in the method, the moisture of the cleaning medium is varied as a function of the surface nature of the floor to be cleaned, which is determined by means of the power consumption of the drive or a defined or definable surface nature, by supplying cleaning agent to the cleaning medium through a cleaning agent dosing unit. The moisture of the cleaning medium required for an optimal cleaning result or for an absolute or local minimum of the vibrations generated by the oscillating total mass may depend on the surface nature of the floor to be cleaned, so that different moistures may be required for different floors to be cleaned. Thus, in order to improve the cleaning result or user comfort, it is necessary to adjust the moisture accordingly, for which purpose the method compares the specific surface nature of the floor to be cleaned with stored values and sets the optimum moisture for this application.

In a further embodiment of the method, an acceleration of the cleaning device caused by a movement of the cleaning device is detected by an acceleration sensor of the vibration sensor, wherein the strength of a vibration detected by the vibration sensor is discriminated against the detected acceleration. The acceleration sensor can be used to determine whether the cleaning device is at rest or is being moved. Using this information, the determination of the moisture can be improved by basing the determination of the moisture solely on the signal component caused by the oscillating movement of the cleaning medium—cleaning medium carrier system.

Preferably, the method selects a cleaning agent delivery mode depending on the strength of a vibration, a surface nature and/or an acceleration of the cleaning device. By selecting the cleaning agent supply mode, the cleaning result and/or the user comfort can be further improved.

In this context, cleaning agent supply mode is understood to mean the type of cleaning agent supply, which takes place manually, automatically after a defined period of time (e.g. 60 seconds) and/or automatically depending on the determined moisture. For example, it is conceivable that the method first determines the surface nature of the floor to be cleaned. In order to improve the accuracy, it can be determined in a subsequent process step whether the cleaning device was at rest or in motion at the time of the determination of the surface nature. If the surface nature was determined with sufficient accuracy, the recorded vibrations can be evaluated in order to record the current moisture of the cleaning medium. Subsequently, an automatic cleaning agent supply can be started until the optimal moisture (maximum cleaning result and/or minimum vibrations) has been reached and the cleaning process can be started. Alternatively, especially if the surface nature and/or the acceleration have not been determined with sufficient accuracy, a standard dosing quantity can be added to the cleaning medium, for example 60 ml, which represents at least a compromise with regard to the respective optimal moistures for a large number of floors to be cleaned.

BRIEF DESCRIPTION OF THE INVENTION

In the following, the invention is explained by means of an embodiment example with reference to the drawing. The drawing shows in FIG. 1 a perspective view of a cleaning device designed as an attachment, in FIG. 2 a perspective view of the attachment connected to a suction wiper, and in FIG. 3 an example of a curve of strength of vibration and a vibration perceived by a user as a function of the moisture of the cleaning medium.

DESCRIPTION OF THE INVENTION

The cleaning device 1 shown in FIG. 1 is provided with a housing 3, with a connecting piece 5, with at least one cleaning medium 7 for receiving a cleaning agent and with a cleaning medium carrier 9 for receiving the cleaning medium 7. A vibration sensor 11 is adapted to detect a vibration or a strength of a vibration, and a controller 13 is adapted to evaluate the data of the at least one vibration sensor 11. In the example shown, the vibration sensor 11, the controller 13, a cleaning agent dosing unit 17 having a tank 15, and a drive 19 are arranged in the housing 3, and the connecting piece 5 is pivotably mounted in the housing 3. The cleaning medium 7 is located on an underside of the cleaning medium carrier 9 facing away from an underside of the housing 3, which cleaning medium carrier 9 has a connection suitable for transporting liquid to the tank 15 of the cleaning medium metering unit 17 for supplying the cleaning medium to the cleaning medium 7, the necessary flow work being provided by an electrically actuable pump 21 also arranged in the housing 3. A signal and data interface enables communication between the controller 13 and the cleaning agent dosing unit 17.

The vibration sensor 11 detects the vibrations induced by the oscillating movement of the system cleaning medium 7—cleaning medium carrier 9 or the strength of these vibrations and forwards this information to the controller 13. For this purpose, the vibration sensor 11 is connected to the controller 13 for transferring signals.

The controller 13 evaluates the data transmitted by the vibration sensor 11 and uses them to determine the moisture of the cleaning medium 7. A user can be informed of the moisture content determined via an indicator 23 arranged in the housing 3, the indicator 23 being connected to the controller 13 for transferring signals. Within the scope of the evaluation, the controller 13 compares the detected vibrations, i.e. the transmitted data, with values stored in a memory unit of the controller 13. The stored values can also be threshold values, in particular threshold values for the strength of the vibrations, which the controller 13 notifies the user if they are exceeded and/or undershot. Depending on the result of the evaluation, the electrically operable pump 21 of the cleaning agent dosing unit 17 can deliver cleaning agent from the tank 15 to the cleaning medium 7. The controller 13 can also detect the condition of the cleaning medium 7 by means of the comparison and inform the user about this.

In addition to determining the moisture of the cleaning medium 7, the controller 13 is adapted to determine the surface nature of the floor to be cleaned, for which purpose the controller 13 is connected to the drive 19 for transferring signals. Via this connection, the controller 13 receives information about the performance data of the drive 19, which is used as a basis for determining the surface nature, in particular the coefficient of friction. The surface nature determined in this way can also be compared with at least one surface nature stored in the memory unit of the controller 13.

An acceleration sensor integrated in the acceleration sensor 11 detects the accelerations occurring during the movement of the cleaning device and forwards this data by means of a signalling connection to the controller 13, which evaluates this data and, if necessary, discriminates the data transmitted by the vibration sensor 11 against this data in order to improve the accuracy of the determination of the moisture of the cleaning medium 7.

Figure 2:
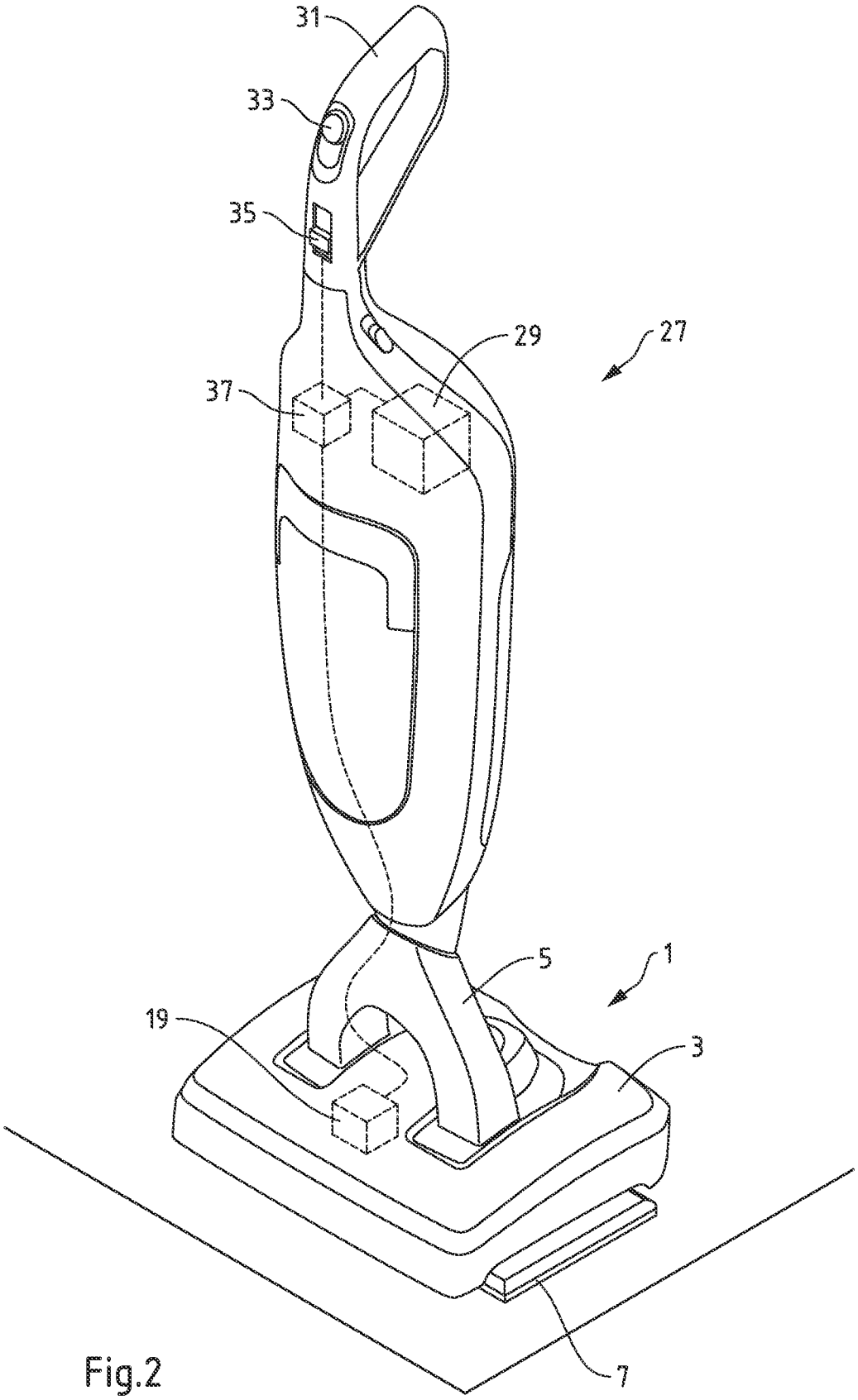

FIG. 2 shows a suction wiper 27 with a mounted cleaning device 1. The energy required to supply the devices arranged in the housing 3 of the cleaning device 1 is provided by a voltage source 29 arranged in the suction wiper 27 via the contacts integrated in the connector 5. The suction wiper 27 has a switch 33 arranged in a handling handle 31 for switching the suction wiper 29 and the cleaning device 1 on and off. A further switch 35 for activating and deactivating a wiping function is arranged below this. The wiping function can be understood as a supply of cleaning agent to the cleaning medium 7 as well as operation of the drive 19. Furthermore, the voltage source 29 has a control 37 which controls the functions of the suction wiper 27 and which can interact with, cooperate with and/or replace the controller 13 of the cleaning device 1.

Figure 3:
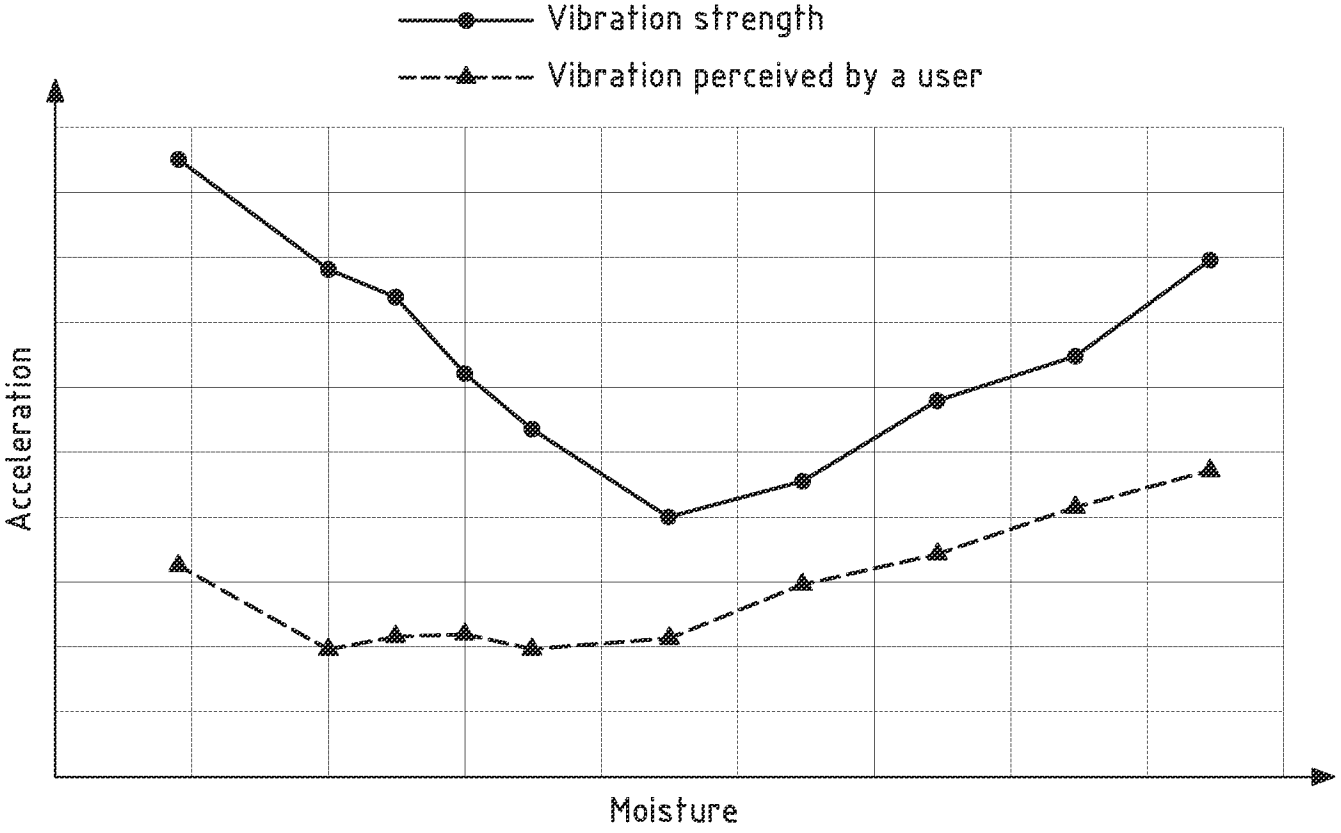

FIG. 3 shows an example of the course of a vibration strength (solid line) and a vibration perceived by a user (dashed line) as a function of the moisture of the cleaning medium 7, which are shown as acceleration in the example shown. The correlation between the strength of the vibration and the moisture of the cleaning medium 7, the correlation between the perceived vibration and the moisture of the cleaning medium 7, the minimum of the strength of the vibration at approximately an average moisture of the cleaning medium 7 and the minimum of the vibration perceived by a user, which is detectable at a lower moisture of the cleaning medium 7, can be clearly seen.

The invention claimed is:

1. A cleaning device comprising:

a housing, a cleaning agent dosing unit comprising an electrically operated pump, at least one cleaning medium configured to receive a cleaning agent from the electrically operated pump, a cleaning medium carrier configured to receive the cleaning medium on an underside of the cleaning medium carrier, a drive configured to drive the cleaning medium carrier, at least one vibration sensor arranged in the housing, the at least one vibration sensor configured to detect a strength of a vibration, and a controller configured to assess a content of liquid cleaning agent in the cleaning medium based on a variation in the strength of vibration detected by the at least one vibration sensor, wherein the variation is caused by changes in a total oscillating mass of the cleaning medium due to the content of liquid cleaning agent in the cleaning medium.

2. The cleaning device according to claim 1, wherein the controller is further configured to:

determine a surface nature of a floor to be cleaned, and evaluate performance data of the drive for determining the surface nature.

3. The cleaning device according to claim 1, wherein the at least one vibration sensor comprises at least one acceleration sensor configured to detect a movement of the housing.

4. The cleaning device according to claim 1, wherein the controller comprises a memory unit, and wherein the controller is further configured to compare a detected strength of vibration with at least one defined or definable strength of vibration.

5. The cleaning device according to claim 4, wherein the controller is further configured to compare a determined surface nature with at least one defined or definable surface nature.

6. The cleaning device according to claim 4, wherein the cleaning agent dosing unit is arranged in the housing, the cleaning agent dosing unit further comprising a tank and a data and signal interface, and wherein the controller is configured to evaluate data of the cleaning agent dosing unit.

7. The cleaning device according to claim 4, wherein the controller is further configured to notify a user when at least one threshold value of a strength of a vibration is undershot or exceeded.

8. The cleaning device according to claim 7, wherein the at least one threshold value of a strength of a vibration is an upper and/or lower threshold value.

9. A method of operating a cleaning device, comprising:

assessing a content of liquid cleaning agent in a cleaning medium;

detecting a strength of vibration in the cleaning device; and evaluating a change in the strength of the vibration, wherein the cleaning device comprises:

a housing, a cleaning agent dosing unit comprising an electrically operated pump, wherein the cleaning medium is configured to receive the cleaning agent from the electrically operated pump, a cleaning medium carrier configured to receive the cleaning medium on an underside of the cleaning medium carrier, a drive configured to drive the cleaning medium carrier, at least one vibration sensor arranged in the housing, the at least one vibration sensor configured to detect the strength of a vibration, and a controller configured to assess the content of liquid cleaning agent in the cleaning medium based on a variation in the strength of vibration detected by the at least one vibration sensor, wherein the variation is caused by changes in a total oscillating mass of the cleaning medium due to the content of liquid cleaning agent in the cleaning medium.

10. The method according to claim 9, further comprising:

determining a surface nature of a floor to be cleaned by receiving performance data related to a coefficient of friction.

11. The method according to claim 9, wherein the content of liquid cleaning agent in the cleaning medium is varied as a function of the strength of vibration detected by the at least one vibration sensor by supplying cleaning agent to the cleaning medium by means of the cleaning agent dosing unit.

12. The method according to claim 11, wherein the content of liquid cleaning agent in the cleaning medium is varied as a function of a surface nature of a floor to be cleaned, which is determined by means of power consumption of the drive or by means of a defined or definable surface nature, by supplying cleaning agent to the cleaning medium by means of the cleaning agent dosing unit.

13. The method according to claim 12, wherein the cleaning device further comprises an acceleration sensor, and wherein the method further comprises:

detecting an acceleration signal of the cleaning device caused by a movement of the cleaning device by the acceleration sensor and providing the acceleration signal to the controller, and discriminating a strength of a vibration signal detected by the at least one vibration sensor and providing the vibration signal to the controller so that it may be compared against the detected acceleration signal.

14. The method according to claim 13, further comprising:

selecting a cleaning agent supply mode based on a strength of a vibration, a surface nature and/or an acceleration of the cleaning device.

* * * * *